US009259616B2

(12) United States Patent
Carr

(10) Patent No.: US 9,259,616 B2
(45) Date of Patent: Feb. 16, 2016

(54) SPORT BOARD IMPACT ABSORBING TRAINING DEVICE

(71) Applicant: Andy Carr, San Clemente, CA (US)

(72) Inventor: Andy Carr, San Clemente, CA (US)

( * ) Notice: Subject to any disclaimer, the term of this patent is extended or adjusted under 35 U.S.C. 154(b) by 90 days.

(21) Appl. No.: 13/834,749

(22) Filed: Mar. 15, 2013

(65) Prior Publication Data

US 2013/0310235 A1 Nov. 21, 2013

Related U.S. Application Data

(60) Provisional application No. 61/649,017, filed on May 18, 2012.

(51) Int. Cl.

| | |
|---|---|
| ***A63B 21/00*** | (2006.01) |
| ***A63B 26/00*** | (2006.01) |
| ***A63B 69/00*** | (2006.01) |
| *A63B 21/008* | (2006.01) |

(52) U.S. Cl.

CPC ..... *A63B 26/003* (2013.01); *A63B 21/022* (2013.01); *A63B 21/4033* (2013.01); *A63B 69/0093* (2013.01); *A63B 21/008* (2013.01); *A63B 21/00069* (2013.01); *A63B 21/0085* (2013.01); *A63B 21/0087* (2013.01); *A63B 2208/12* (2013.01); *A63B 2209/10* (2013.01); *A63B 2210/50* (2013.01)

(58) Field of Classification Search

CPC ..... A63B 21/00
USPC ..... 482/51, 52, 142
See application file for complete search history.

(56) References Cited

U.S. PATENT DOCUMENTS

| | | | | |
|---|---|---|---|---|
| 5,062,629 | A * | 11/1991 | Vaughan | 482/51 |
| 5,441,466 | A * | 8/1995 | Piaget et al. | 482/52 |
| 6,648,363 | B2 | 11/2003 | Gordon | |
| 2006/0287173 | A1 * | 12/2006 | Guadagno | 482/142 |

* cited by examiner

*Primary Examiner* — Jerome W Donnelly
(74) *Attorney, Agent, or Firm* — Stetina Brunda Garred & Brucker

(57) ABSTRACT

A sport board training device for use on a support surface. The sport board training device includes a hand-portable board member having an upper surface and an opposing lower surface. A suspension member is coupled to the lower surface of the board member and is engagable with the support surface. The suspension member is transitional between a compressed position and an extended position relative to the board member as the lower surface of the board member moves toward the support surface when the suspension member is engaged with the support surface.

20 Claims, 3 Drawing Sheets

SPORT BOARD IMPACT ABSORBING TRAINING DEVICE

CROSS-REFERENCE TO RELATED APPLICATIONS

This United States non-provisional patent application claims the benefit of U.S. Provisional Application Ser. No. 61/649,017, filed May 18, 2012, the contents of which are expressly incorporated herein by reference.

STATEMENT RE: FEDERALLY SPONSORED RESEARCH/DEVELOPMENT (Not Applicable)

BACKGROUND OF THE INVENTION

1. Field of the Invention

The present invention relates generally to a sport board training device, and more specifically to a shock-absorbing training device mountable to a sport board for reducing the impact on the user when practicing new tricks.

2. Description of the Related Art

Skateboarding is a well-known sport, which has grown in popularity in recent years. The sport of skateboarding includes several different aspects varying from relatively simple activities, such as simply riding along a sidewalk, to more advanced activities, such as performing aerial tricks in a skate park.

Advancement from such simple, introductory activities to more complex, skilled activities typically requires significant amounts of practice to develop the balance and skill required to perform such tricks. One of the first, and most fundamental, tricks learned by most skateboarders is the "ollie," wherein the skateboarder and the board leap into the air without the use of the skateboarder's hands. Once the ollie is learned, skateboarders generally continue on to learn more difficult tricks, such as the "kickflip" and the "heelflip."

Due to the advanced skill required to perform even the most introductory tricks, most skateboarders require significant amounts of time to perfect the tricks. One of the limitations in acquiring the skill to learn the tricks is that skateboarders typically have to practice the trick on a skateboard outside (on a surface that can withstand the wear and tear of a skateboard). Thus, in times of inclement weather or darkness, most skateboarders cannot practice their tricks because they are typically inside.

Another limitation commonly encountered when learning new tricks is the high-impact encountered by the skateboard when learning new tricks. Skateboards are not typically fitted with forgiving suspension systems, and therefore, when practicing new tricks, the skateboarder oftentimes endures large impacts as the skateboarder hones his craft. Therefore, due to the physical nature associated with practicing skilled skateboarding activities, young children are generally withheld from such activities until they develop the strength to endure the rigorous training.

As is apparent from the foregoing, there is a need in the art for a skateboard training device which may be used to learn tricks and skills on sport boards, such as skateboards, wherein the training device is configured to reduce the impact encountered by the user when learning the tricks, and additionally allows the user to practice in many different environments, including inside. The present invention addresses this particular need, as will be discussed in more detail below.

BRIEF SUMMARY OF THE INVENTION

According to an aspect of the present invention, there is provided a sport board training device having one or more suspension elements secured thereto for absorbing impact when a user is attempting a trick or maneuver on the sport board. The training device may be specifically configured and adapted for use indoors, as well as outdoors, which allows a user to maximize the time spent on learning new tricks. Furthermore, the impact absorbing aspect of the training device mitigates the impact imparted to the user, thereby allowing children to more safely practice tricks and maneuvers using the training device.

According to one embodiment, the sport board training device is configured for use on a support surface. The sport board training device includes a hand-portable board member having an upper surface and an opposing lower surface. A suspension member is coupled to the lower surface of the board member and is engagable with the support surface. The suspension member is transitional between a compressed position and an extended position relative to the board member as the lower surface of the board member moves toward the support surface when the suspension member is engaged with the support surface.

The suspension member may include a spring element, a pneumatic piston, or a fluid-filled bladder. The suspension member may be biased toward the extended position by a biasing force. The suspension member may be configured to allow for adjustment of the magnitude of the biasing force. The sport board training device may include a plurality of suspension members.

The sport board training device may further include a gripping element coupled to the board to enhance traction on the board member. The training device may additionally comprise a foot holder coupled to the board member and engageable with a user's foot.

The board member may be a skateboard plank. The board member may define a board thickness as the distance between the upper and lower surfaces, wherein the board thickness is less than five inches. The board member may extend along a longitudinal axis to define a first end and an opposing second end to define a board length therebetween, wherein the board length is less than four feet.

According to another aspect of the present invention, there is provided a training device for use with a board member and a support surface. The training device includes an attachment member detachably securable to the board member. A suspension member is coupled to the attachment member and is engageable with the support surface. The suspension member is transitional between a compressed position and an extended position relative to the securement member as the device moves toward the support surface when the suspension member is engaged with the support surface.

The attachment member may include a strap securable to the board member. The attachment member may additionally include hook and loop fasteners.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION OF THE INVENTION

Figure 1:
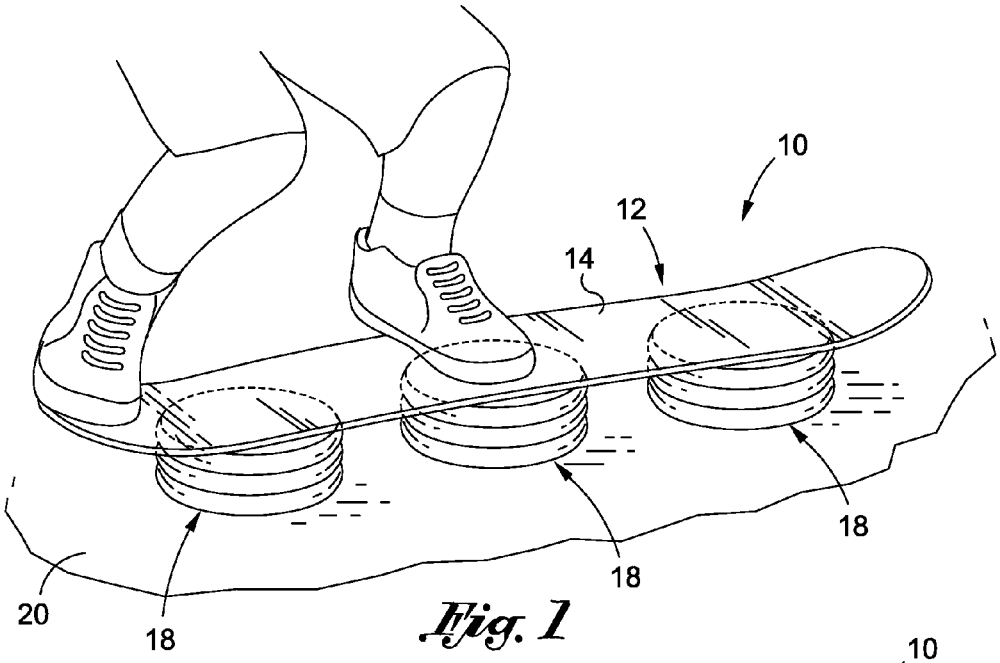
FIG. 1 is an upper perspective view of a sport board training device constructed in accordance with an embodiment of the present invention.

The detailed description set forth below in connection with the appended drawings is intended as a description of the presently preferred embodiments of the invention, and is not intended to represent the only form in which the present devices may be developed or utilized. It is to be understood, however, that the same or equivalent functions may be accomplished by different embodiments that are also intended to be encompassed within the spirit and scope of the invention. It is further understood that the use of relational terms such as first, second, and the like are used solely to distinguish one from another entity without necessarily requiring or implying any actual such relationship or order between such entities.

Referring now to the drawings, wherein the showings are for purposes of illustrating a preferred embodiment of the present invention only, and are not for purposes of limiting the same, there is depicted a sport board training device 10 specifically configured and adapted to allow a user to train for various board sports, including skateboarding, snowboarding, wakeboarding, surfing, skim boarding, or other board sports known by those skilled in the art. The training device 10 allows a user to more safely practice tricks at low impact to perfect the trick and or maneuvers in a safer environment before attempting the trick under more conventional conditions. The training device 10 is configured to be suitable for all ages (e.g., toddlers through adults) and may be used inside or outside, and is thus highly versatile.

According to one embodiment, the training device 10 includes a board member 12 having an upper surface 14 and an opposing lower surface 16, and a suspension member 18 coupled to the lower surface 16 of the board member 12. The suspension member 18 is also engageable with an underlying support surface 20 as the user practices with the training device 10. It is contemplated that the support surface 20 may include the ground, flooring, a road surface, pavement, a carpeted surface, or other support surfaces known in the art. In this regard, the training device 10 is adapted for use on both indoor surfaces as well as outdoor surfaces.

The suspension member 18 is transitional between a compressed position and an extended position relative to the board member 12 as the lower surface 16 of the board member 12 moves toward the support surface 20 when the suspension member 18 is engaged with the support surface 20. For instance, when a user practices a trick on the training device 10, the user may jump and land on the upper surface 14 of the board member 12 with the suspension member 18 interposed between the board member 12 and the support surface 20. As the user's weight and momentum is transferred to the training device 10, the suspension member 18 transitions from the extended position to a compressed position to absorb the load applied by the user. In other words, as the lower surface 16 of the board member 12 moves toward the support surface 20, and thereby compresses the suspension member 18, the suspension member 18 moves from the extended position toward the compressed position.

The suspension member 18 may be biased toward the extended position by a biasing force. Such biasing force may urge the suspension member 18 to return toward the extended position when the user performs the trick. In this regard, the suspension member 18 provides a shock absorbing function to reduce the impact when practicing the trick. As will be explained in more detail below, the magnitude of the biasing force exerted on the suspension member 18 may be adjustable to accommodate varying skill levels and user sizes.

Figure 2:
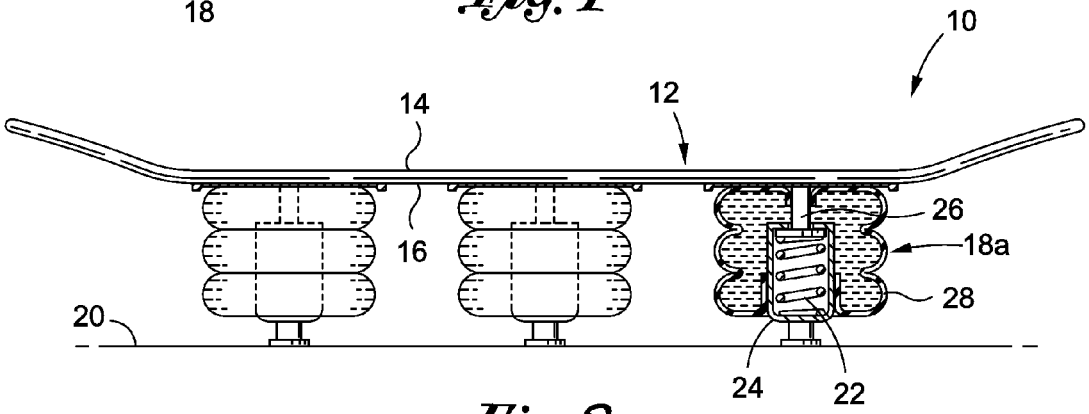
FIG. 2 is a side view of the sport board training device shown in FIG. 1, illustrating a sectional view of a first embodiment of a suspension member coupled to a board member.

According to one embodiment, and referring specifically to FIG. 2, the suspension member 18*a* includes a spring element 22, which may include a conventional coil spring. The tension in the spring element 22 increases as the spring element 22 moves from the extended position to the compressed position (e.g., as the load applied to the board member 12 by the user pushes the board member 12 toward the support surface 20), and the tension in the spring element 22 is reduced as the spring element moves from the compressed position to the extended position (e.g., as the load applied to the board member 12 by the user is reduced and the board member 12 moves away from the support surface 20).

The spring element 22 may be encased in a housing 24 and engageable with a plunger 26 coupled to the board member 12. The plunger 26 transfers the load applied by the user onto the board member 12 to the spring element 22. The housing 24 and plunger 26 may also be enclosed by a shroud or covering 28 to mitigate injury concerns related to movement of the spring element 22, housing 24, and plunger 26. The covering 28 may define a fluid filled cavity defining an internal pressure, which may contribute to the biasing force applied to the board member 12. In other words, the internal pressure of the cavity defined by the covering 28 may apply an upward force on the board member 12 as the lower surface 16 of the board member 12 moves toward the support surface 20. Therefore, the total force applied to the board member 12 may be a combination of the biasing force applied by the spring element 22 as well as the force applied by the internal pressure of the covering 28.

It is contemplated that the biasing force of the suspension element 18*a* may be varied by changing or swapping the spring element 22. In other words, a weaker spring element 22 may be replaced by a strong spring element 22 to increase the biasing force applied to the board member 22.

Although the exemplary embodiment depicted in FIG. 2 shows the spring element 22 encased in the housing 22 and the covering 28, those skilled in the art will recognize that other implementations may include a spring element 22 configured for use without the housing 22, covering, 28 or plunger 26. In this regard, the spring element 22 may be coupled directly to the board member 12.

Figure 3:
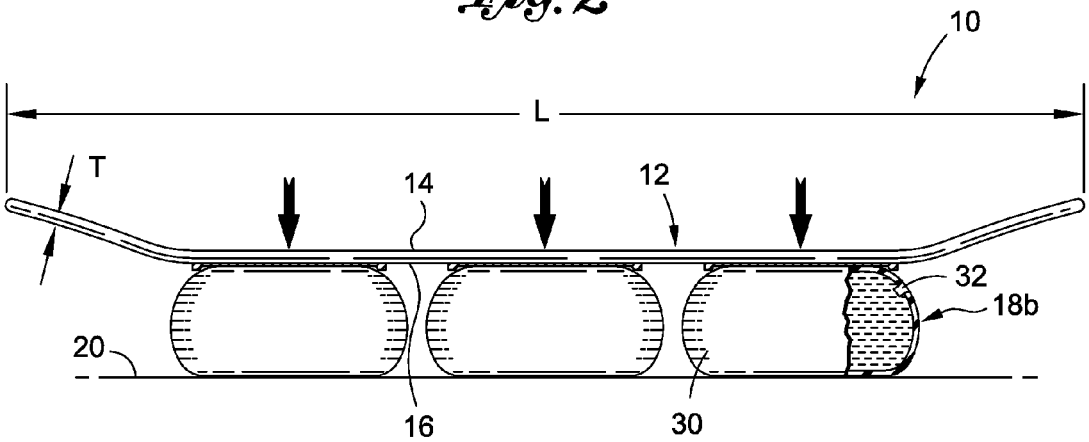
FIG. 3 is a side view of the sport board training device, showing a sectional view of a second embodiment of a suspension member coupled to the board member.

According to another embodiment, and referring to now to FIG. 3, the suspension member 18*b* may include a fluid filled bladder 30. The bladder 30 may include a valve 32 that is used to fill or empty the bladder 30 with fluid (e.g., gas or liquid). The biasing force of the bladder 30 may be adjusted by adjusting the amount of fluid or the type of fluid contained within the bladder 30. In particular, pumping the bladder 30 with fluid increases the pressure within the bladder, which in turn increases the biasing force of the bladder. Conversely, removing fluid from the bladder decreases the pressure within the bladder 30, which in turn reduces the biasing force thereof, and provides a "stiffer" training device 10. Furthermore, the resistance or biasing force applied to the board member 12 by the bladder 30 may be altered by using different fluids having different viscosities.

As the lower surface 16 moves toward the support surface 20, the bladder 30 is compressed between the board member 12 and the underlying support surface 20. The bladder 30 applies a force to the board member 12 which opposes further compression thereof. Thus, the bladder 30 is operative to reduce the impact of landing on the board member 12 when performing/practicing a trick.

It is also contemplated that the suspension member 18 may include a pneumatic piston (not shown) coupled to the board member 12 and designed to provide an opposing force to the board member 12 as the lower surface 16 moves toward the support surface 20.

Figure 5:
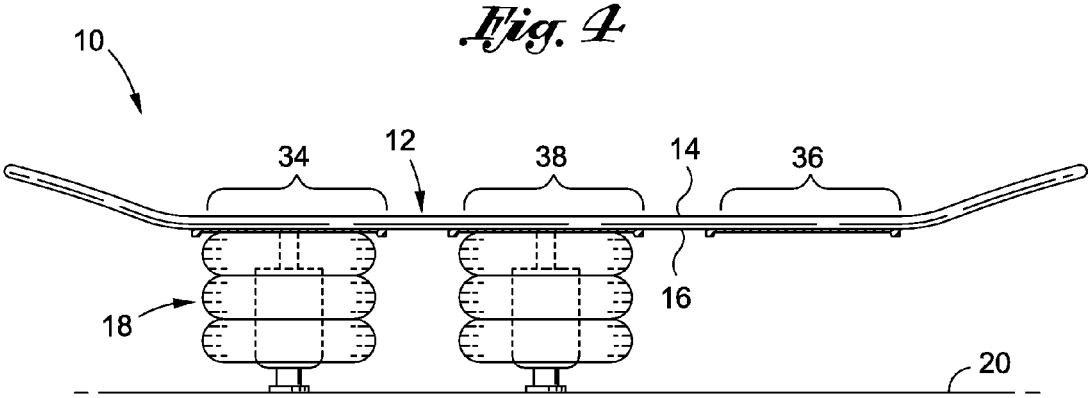
FIGS. 5-9 are side views of the sport board training device with the suspension members arranged in various training configurations.
Figure 6:
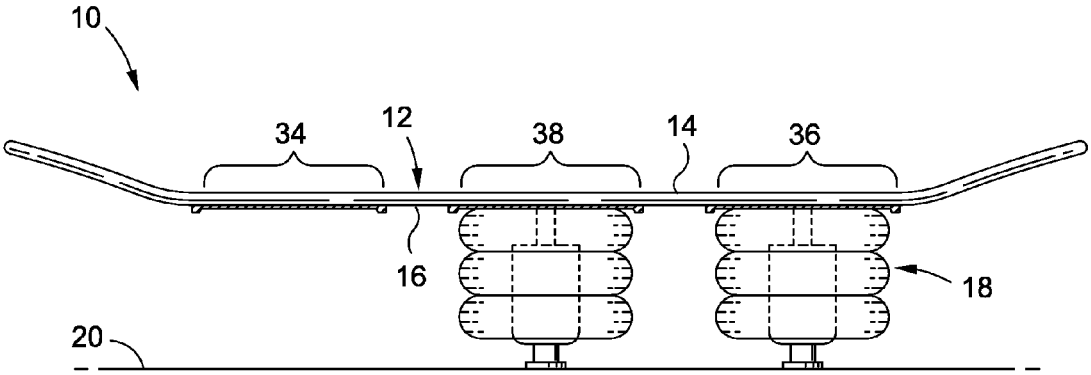

According to one embodiment, the training device 10 includes a plurality of suspension members 18 coupled to the board member 12. The suspension members 18 may be located adjacent the end portions 34, 36 of the board member 12 as well as adjacent the middle portion 38 of the board member 12. According to one implementation of the present invention, the suspension members 18 are selectively positionable relative to the board member 12 in prescribed locations defined by the user. In this regard, the user may desire to position one suspension member 18 adjacent a first end portion 34 of the board member 12, and a second suspension member 18 adjacent the middle portion 38 of the board member 12, with a second end portion 36 of the board member 12 free of a suspension member 18 (see FIG. 5). It is also contemplated that the second end portion 36 and middle portion 38 of the board member 12 may be coupled to suspension members 18, while the first end portion 34 is disconnected from a suspension member 18 (see FIG. 6). Alternatively, a user may desire to include two suspension members 18 positioned adjacent respective end portions 34, 36 of the board member 12, while the middle portion 38 of the board member 12 does not include a suspension member 18.

Figure 7:
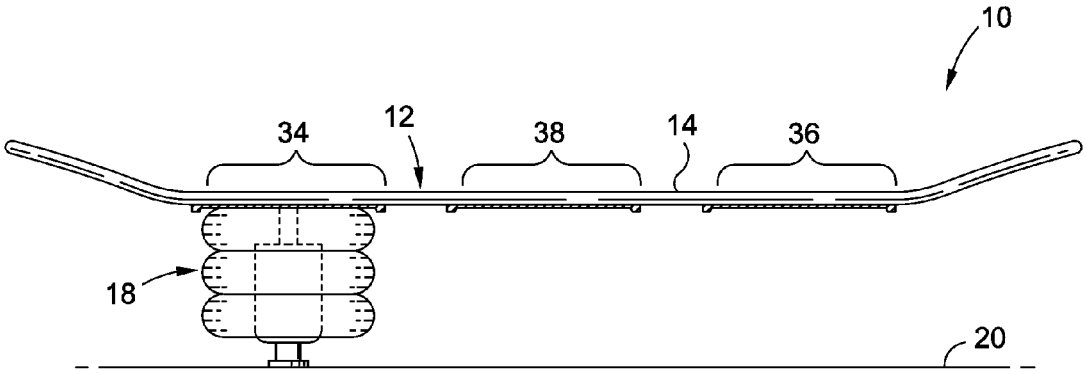
Figure 8:
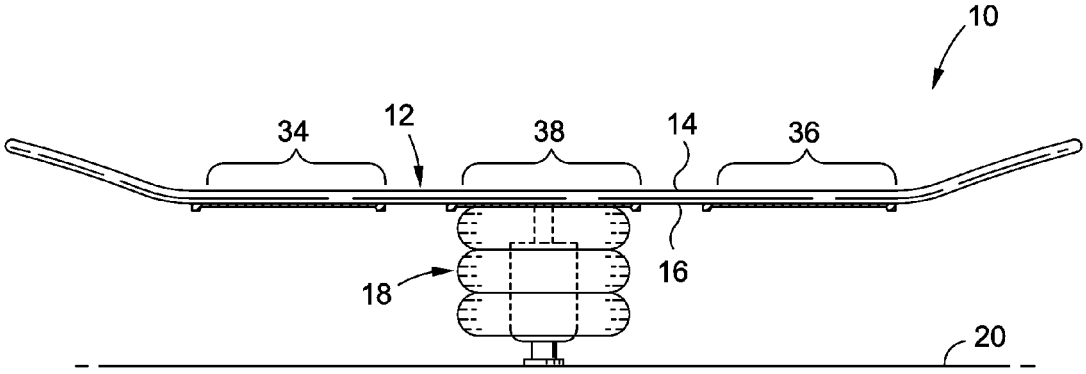
Figure 9:
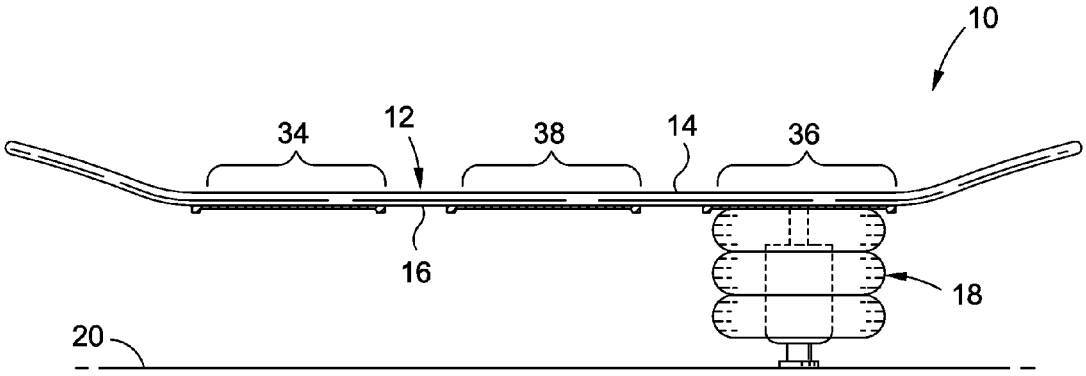

In yet another configuration, a user may desire to place one or more suspension members 18 adjacent the middle portion 38 of the board member 12 while the end portions 36, 38 of the board member 12 are free of suspension members 18 (see FIG. 8). Other exemplary configurations are shown in FIGS. 7 and 9, and include a suspension member 18 adjacent one end portion (adjacent the first end portion 34 in FIG. 7 and adjacent the second end portion 36 in FIG. 9), with the remainder of the board member 12 being disconnected from suspension members 18.

The various placement of the suspension members on the board member 12 may be desirable for training for particular tricks and maneuvers. Along these lines, it may be desirable to position the suspension member(s) 18 on the board member 12 in a first configuration to train for a first trick, and to position the suspension member(s) 18 on the board member 12 in a second configuration to train for a second trick.

Figure 4:
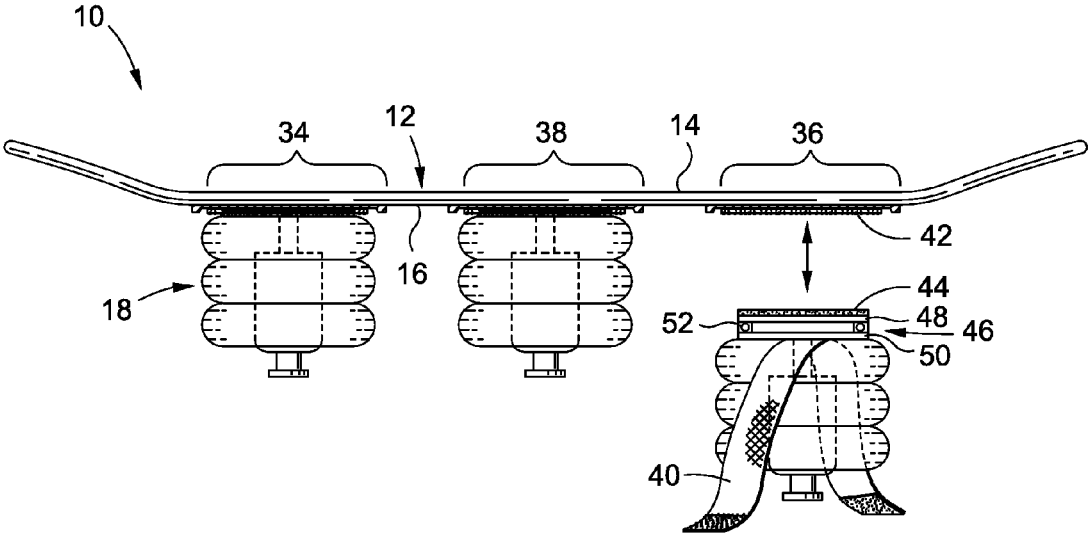
FIG. 4 is a side, partial exploded view of a suspension member detached from the board member.

The selective placement of the suspension members 18 along the board member 12 may be effectuated by an attachment mechanism specifically configured and adapted to allow for selective detachable engagement between the board member 12 and the suspension member 18. According to one embodiment, the attachment mechanism includes a strap 40 (see FIG. 4) which is coupled to the suspension member 18 and is securable to the board member 12 at the prescribed location desired by the user. The strap 40 may be wrapped around the board member 12 and secured to itself via strap fasteners, such as hook and loop fasteners (e.g., VELCRO™), buckle fasteners, snap fasteners, or other mechanical fasteners known by those skilled in the art.

According to another embodiment, the attachment mechanism may include hook and loop fastening material to detachably engage the suspension member 18 to the board member 12. The lower surface 16 of the board member 12 may include a sheet of hook and loop fastening 42 material adhered thereto, and the suspension member 18 may include a corresponding portion of hook and loop material 44 connected thereto to allow for selective engagement between the suspension member 18 and the board member 12.

In another embodiment, the attachment member may include a mating tongue and groove construction which secures the suspension member 18 to the board member 12. For instance, the board member 12 may include a plurality of dove-tail grooves extending into the board member 12 from the lower surface 16 thereof, which matingly engage with a corresponding tongue or projection coupled to the suspension member 18. Engagement between the suspension member 18 and the board member 12 may be effectuated by sliding the tongue of the suspension member 18 into the particular groove located at the prescribed location on the board member 12. The suspension member 18 may be detached from the board member 12 by sliding the tongue out of the groove causing the suspension member 18 to be released from the board member 12.

Those skilled in the art will readily understand that although the foregoing describes the groove formed in the board member 12 and the tongue formed on the suspension member 18, the other embodiments may include the groove formed on the suspension member 18 and the tongue formed on the board member 12.

Other attachment members known in the art may be incorporated into the training device to allow for selective engagement between the board member and the suspension member. For instance, the attachment member may employ magnets, clamps, fasteners, adhesives, pins, etc.

According to another implementation of the present invention, the suspension member 18 is more permanently secured to the board member 12, although the position of the suspension member 18 may still be varied by the user. Along these lines, the suspension member 18 may be coupled to a track mechanism which allows the suspension member 18 to translate relative to the board member 12 to vary the position of the suspension member 18 relative to the board member 12. The suspension member 18 may be lockable in various locations along the track mechanism to selectively position the suspension member 18 in the position desired by the user. In the case of a plurality of suspension members 18, each of the suspension members 18 may translate within a common track mechanism, or alternatively, within separate, dedicated track mechanisms for each suspension member 18.

According to one embodiment, the suspension member 18 is rotatably coupled to the board member 12 via a rotating joint member 46. The rotating joint member 46 may include a pair of plates 48, 50 having one or more bearings 52 disposed between the plates 48, 50 to allow for rotation of the board member 12 relative to the suspension member 18. Although the exemplary embodiment shows the rotating joint member 46 integrated into a detachable suspension member 18, it is understood that other embodiments may include a rotating joint member 46 integrated into a suspension member 18 that is more permanently mounted to the board member 12.

The size, shape and material of the board member 12 may correspond to several board bodies commonly used in board sports. Along these lines, the board member 12 may correspond to a skateboard plank, a snowboard, a surfboard, a skim board, a wake board, skis (e.g., water skis or snow skis), a knee board, or other boards used, or later developed, in board sports. The exemplary embodiment depicts the board member 12 as a skateboard plank having a first end and an opposing second end to define a board length, "L" therebetween, while a board thickness "T" is defined as the distance between the upper and lower surfaces 14, 16 of the board member 12. Although the board length L and board thickness T may vary from one embodiment to the next, most skateboards define a board length L that is less than three feet, although some long boards may extend beyond that dimension, and the board thickness T is less than an inch. It is understood that some applications may include a board length L and a board thickness T which is greater than the skateboard dimensions, for instance a surfboard is going to have a longer board length L and board thickness T. In most embodiments, the board member 12 will define a size and configuration which allows the training device 10 to be hand portable by a single user.

The upper surface 14 of the board member 12 is configured to support a user standing on the board member 12. Accordingly, one embodiment of the board member 12 includes a gripping element coupled to the board member 12 to enhance traction on the board member 12. The gripping element may include rubber strips, sand paper, or other gripping elements known by those skilled in the art.

The training device 10 may further include a foot holder or binding coupled to the board member 12 to secure the user to the board member 12. The binding may operate in a manner similar to conventional board sports, such as a wake board binding, snowboard binding, or the like to provide the user with a similar feel as he would normally experience on a conventional board.

Although the foregoing describes a training device 10 that includes a board member 12 and a suspension member 18, it is contemplated that other aspects of the invention include a suspension member 18 that may be used with an existing sport board. In particular, the suspension member 18 may be sold separate from a board member 12 and may be configured for use with a conventional skateboard, surf board, wake board, or the like. The suspension member 18 may be coupled to the existing sport board via a strap 40, hook and loop fastening material or other fastening techniques known in the art. Furthermore, the suspension member 18 may employ springs, fluid bladders, pistons or other biasing elements discussed above or known in the art.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combinations described herein. Thus, the scope of the claims is not to be limited by the illustrated embodiments.

What is claimed is:

1. A sport board training device for use on a support surface, the sport board training device comprising:

a hand-portable board member having an upper surface and an opposing lower surface;

an attachment member detachably securable to the board member and configured to be substantially immovable relative to the board member when secured thereto;

a suspension member coupled to the attachment member and engagable with the support surface, the suspension member being transitional between a compressed position and an extended position relative to the board member as the lower surface of the board member moves toward the support surface when the suspension member is engaged with the support surface, the suspension member being biased toward the extended position by a biasing force; and a rotating joint member disposed between the suspension member and the attachment member, the rotating joint member being configured to enable rotation of the suspension member relative to the attachment member about a fixed rotation axis.

2. The sport board training device recited in claim 1, wherein the suspension member includes a spring element.

3. The sport board training device recited in claim 1, wherein the suspension member includes a pneumatic piston.

4. The sport board training device recited in claim 1, wherein the suspension member includes a fluid-filled bladder.

5. The sport board training device recited in claim 1, wherein the suspension member is configured to allow for selective adjustment of the magnitude of the biasing force.

6. The sport board training device recited in claim 1, further comprising a gripping element coupled to the board to enhance traction on the board member.

7. The sport board training device recited in claim 1, further comprising a foot holder coupled to the board member and engageable with a user's foot.

8. The sport board training device recited in claim 1, wherein the board member is a skateboard plank.

9. The sport board training device recited in claim 1, further comprising a plurality of suspension members.

10. The sport board training device recited in claim 1, wherein the board member defines a board thickness as the distance between the upper and lower surfaces, the board thickness being less than five inches.

11. A training device for use with a board member and a support surface, the training device comprising:

an attachment member detachably securable to the board member and configured to be substantially immovable relative to the board member when secured thereto;

a suspension member coupled to the attachment member and engagable with the support surface, the suspension member being transitional between a compressed position and an extended position relative to the securement member as the device moves toward the support surface when the suspension member is engaged with the support surface, the suspension member being biased toward the extended position by a biasing force; and a rotating joint member disposed between the suspension member and the attachment member, the rotating joint member being configured to enable rotation of the suspension member relative to the attachment member about a fixed rotation axis.

12. The training device recited in claim 11, wherein the attachment member includes a strap wrappable around the board member.

13. The training device recited in claim 11, wherein the attachment member includes hook and loop fasteners.

14. The sport board training device recited in claim 11, wherein the suspension member includes a coil spring and a bladder at least partially circumnavigating the coil spring.

15. The sport board training device recited in claim 11, wherein the suspension member includes a pneumatic piston.

16. The sport board training device recited in claim 11, wherein the suspension member includes a fluid-filled bladder.

17. The sport board training device recited in claim 11, wherein the magnitude of the biasing force is adjustable.

18. The sport board training device recited in claim 1, wherein the suspension member includes a first compressible element and a bladder circumnavigating and covering the first compressible element.

19. A sport board training device for use on a support surface, the sport board training device comprising:

a hand-portable board member having an upper surface and an opposing lower surface;

an attachment member detachably securable to the board member and configured to be substantially immovable relative to the board member when secured thereto; and a suspension member coupled to the attachment member and engagable with the support surface, the suspension member being transitional between a compressed position and an extended position relative to the board member as the lower surface of the board member moves toward the support surface when the suspension member is engaged with the support surface, the suspension member being biased toward the extended position by a biasing force;

the suspension member including a first compressible element and a bladder circumnavigating and covering the first compressible element.

20. The sport board training device recited in claim 19, wherein the suspension member is configured to allow for selective adjustment of the magnitude of the biasing force.

* * * * *